United States Patent [19]

Naess

[11] 4,447,247

[45] May 8, 1984

[54] METHOD AND APPARATUS FOR COLLECTING OIL AND GAS FROM AN UNDERWATER BLOW-OUT

[76] Inventor: Erik B. Naess, Nils Lauritssons v. 46, Oslo, Norway

[21] Appl. No.: 290,810

[22] PCT Filed: Dec. 18, 1980

[86] PCT No.: PCT/NO80/00044

§ 371 Date: Jul. 31, 1981

§ 102(e) Date: Jul. 31, 1981

[87] PCT Pub. No.: WO81/01864

PCT Pub. Date: Jul. 9, 1981

[30] Foreign Application Priority Data

Dec. 21, 1979 [NO] Norway ..... 794260

[51] Int. Cl.[3] ..... E02B 23/00

[52] U.S. Cl. ..... 55/55; 55/172; 210/170; 210/923; 405/60; 405/210

[58] Field of Search ..... 210/170, 242.1, 923; 405/60, 210; 55/55, 171, 172

[56] References Cited

U.S. PATENT DOCUMENTS

| | | | |
|---|---|---|---|
| 3,681,923 | 8/1972 | Hyde | 210/170 X |
| 3,745,773 | 7/1973 | Cunningham | 210/242.1 |
| 3,762,548 | 10/1973 | McCabe | 210/923 |
| 3,921,558 | 11/1975 | Redshaw | 405/210 |
| 4,324,505 | 4/1982 | Hammett | 210/923 |

*Primary Examiner*—John Adee
*Attorney, Agent, or Firm*—Ladas & Parry

[57] ABSTRACT

A method and an apparatus for collecting oil and gas flowing uncontrolled into a body of water beneath the water surface, especially in a blow-out from a point at the sea bed. The oil and gas discharged from the blow-out location is caught and ascends towards the surface within a tubular shell body and the gas is collected in a floating gas bell provided at the upper end portion of the shell body and forming a gas or liquid trap against the surrounding water in that it has an outer wall projecting downwards and surrounding an upper portion of the shell body. The gas is thus automatically placed under a controllable positive pressure in that the displacement of the gas bell in the medium within the shell body can be varied by ballast means. The apparatus includes an upper member (2) constituting a gas-collecting bell, and a lower member (1) constituted by the shell body. The upper member (2) comprises a shell-body-enclosing outer wall (7) and an inner wall (8) enclosed by the shell body (1), which walls (7, 8) are mutually sealingly connected at the top (9) so as to form an annular compartment (10) which is open at the bottom and in which a top part (5) of the shell body (1) projects, a bottom part (11) which, at the bottom of the inner wall (8), closes the central space (12) defined by the inner wall (8), and ballast tanks (13) for adjusting the displacement of the upper member (2) in the medium within the shell body (1).

17 Claims, 3 Drawing Figures

METHOD AND APPARATUS FOR COLLECTING OIL AND GAS FROM AN UNDERWATER BLOW-OUT

Figure 1:
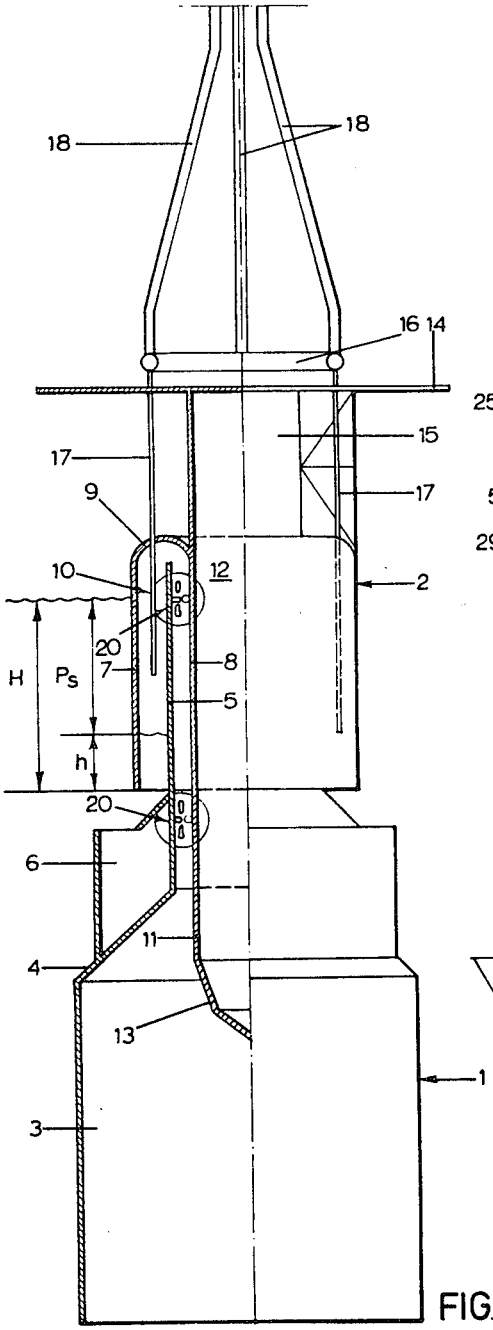

The present invention relates to a method for collecting oil and gas flowing uncontrolled into a body of water beneath the water surface, especially in a blow-out from a point at the sea bed, wherein discharging oil and gas from the blow-out location are caught and ascends towards the surface within a tubular shell body. Further, the invention relates to an apparatus for carrying out the method.

In the course of the last 10–15 years the exploitation of oil and gas deposits in geological layers beneath sea and ocean areas has become more and more common. The exploitation of these energy resources comprises several phases from the drilling of test wells up to and including the establishment of production facilities. Test drilling as well as production can take place from platform structure which are either resting directly on the sea bed or are maintained fixedly positioned and floating above one or more test or production wells. In spite of advanced technology and substantial safety measures, there is always a risk of accidents caused by e.g. human error, material fatigue, system malfunctioning or the influence of forces of nature. Such accidents may cause the disconnection of the pipe work between oil well and platform. The situation may then arise that oil or gas or a combination of these components flows uncontrolled into the sea. Due to their lower density, the components ascend towards the water surface and disperse with resulting pollution and detrimental effects to bird life and the environment of marine biology.

The natural gas emitted to the atmosphere at the surface of the sea will after intermingling with air constitute large explosive gas volumes. During escape of gas or a mixture of gas and oil over a period of time it may, therefore, be desirable or necessary to burn the gas as it emerges from the sea. The lighter fractions of oil (hydrocarbons) will also take part in the combustion process. A subsequent cooling of the released oil and further influence from the waves may lead to the formation of agglomerates and larger lumps which apparently sink after a period of time.

The conventional technology for the collection of the discharged oil has largely been to the effect that one attempts to collect the floating oil by means of oil dams which are laid out to collect the oil on the sea surface. Dams of different types have been constructed for use under different conditions. However, in practice they have proved to have shortcomings, in particular when the waves exceed a certain height. The oil dams also presuppose the participation of a suitable vessel for skimming of oil from the surface, in addition to the vessels required to maintain the dams in position against the weather. Collection of surface oil also involves the drawback that large quantities of water must be separated from the oil and returned to the sea. Usually there will also occur a substantial loss of lighter hydrocarbon fractions to the atmosphere due to evaporation.

Oil may be released from an oil well in quantities of the order of 10,000–50,000 barrels per 24 hours (1 barrel=42 US Gallons) which, according to the metric system, corresponds to 1500–8000 $m^3$ per 24 hours. It is further not uncommon that an oil well can operate with a GOR figure of approximately 1000. (GOR=Gas/Oil Ratio defined as cubic feet of gas per minute and barrel of oil).

In metric units this means a gas emission or discharge of approximately 1700 $m^3/h$ and barrel, or approximately 10,000 $m^3/h$ and $m^3$ oil. Thus, with an oil discharge in the range of 50–300 $m^3/h$, the gas discharge will be 500,000–3,000,000 $m^3/h$. Variations in excess of the above may very well occur depending upon the structure of the producing geological layer. One also has to expect variations in the GOR figure from one and the same well as a function of time.

The purpose of the invention is to provide a method and an apparatus enabling the collection and the control of both oil and gas escaping into the ocean or into a lake beneath the water surface, both oil and gas being collected prior to reaching the surface, and further enabling separation of oil and gas and storage of large quantities of oil for subsequent transfer to a vessel on a continuous or intermittent basis, and burning of the gas under controlled conditions or also complete or partial utilization of the gas, e.g. for the production of electric power.

The above mentioned purpose is achieved with a method of the type set forth above which, according to the invention, is characterized in that the ascending gas is collected in a floating gas bell provided at the upper end portion of the shell body and forming a gas or liquid trap against the surrounding water the bell having an outer wall projecting downwards and surrounding an upper portion of the shell body, whereby the gas is automatically placed under a controllable positive pressure in that the displacement of the gas bell in the medium within the shell body can be varied by ballast means.

In an advantagesous embodiment of the method the gas in the gas bell, at a certain positive pressure in the gas bell, is drained off therefrom in a controlled manner through tube connections to a place of combustion or utilization.

An apparatus for collecting oil and gas flowing uncontrolled into a body of water beneath the water surface, method comprises a tubular shell body for the catching of oil and gas ascending towards the surface from the blow-out location, and is according to the invention characterized in that it includes an upper member constituting a gas-collecting bell, and a lower member constituted by the shell body, the upper member comprising a shell body enclosing outer wall and an inner wall enclosed by the shell body, which walls are mutually sealingly interconnected at the top so as to form an annular compartment which is open at the bottom and into which a top part of the shell body projects, a bottom part which at the bottom of said inner wall closes the central space defined by the inner wall, and ballast tanks for adjusting the displacement of the upper member in the medium within the shell body. The shell body constituting the lower member has its center of gravity so disposed that the shell wall is kept essentially vertical in operational position, and is provided with a ballast tank means for variation of the buoyancy of the lower member.

The invention makes it possible to control varying quantities of released gas. There is no lower limit of capacity and the principle implicitly contains a solution for the control of all gas emissions or blow-outs which normally may be supposed to occur from a well head. The invention also provides the opportunity to handle gas quantities from several well heads. The gas can be burned under controlled conditions or also completely or partly be used in the production of electric power by means of known methods, e.g. a gas turbine. However, it is also possible to install equipment for the production of liquefied natural gas (LNG) as part of the apparatus according to the invention.

The invention takes into account that the gas trapped in the gas bell by an accident can be mingled with air, and that such a mixture can be ignited and release an uncontrolled combustion. The invention provides for absorption or deflection of the shock wave occurring by such a combustion, without simultaneously releasing oil to the surrounding area, as a result of the fact that the submerged gas bell, acting as a water trap against the sea, will act as a gigantic safety valve. By a sudden combustion pressure the water trap will be temporarily inactive as the liquid column in the gas bell will be forced downwards as a piston. The pressure and the expanding combustion gases are released into the sea and expand to atmospheric conditions against the water pressure, thereby causing cascade formations which will contribute to dampen and absorb the shock wave which may be caused by a combustion.

The invention enables collection of oil and gas from a blow-out at all water depths at which it is feasible to drill for oil or gas, the lower member of the apparatus enabling an extension of draft as well as an increase of the diameter of the shell body. Further, the apparatus is of such a nature that one is independent of sea currents at the surface as well as on larger depths, provided that these may be characterized as sea currents caused by gravitation forces and natural thermal effects. The apparatus can operate under the most extreme variations in tidal water, and in consideration of given operational conditions it may be designed for very large wave heights as well as the more moderate conditions which normally will occur. The upper member or gas bell after all has its displacement located in enclosed oil, so that wave motion or other forces in the surrounding sea will have an insignificant influence on the movement of the apparatus in the sea.

Figure 3:
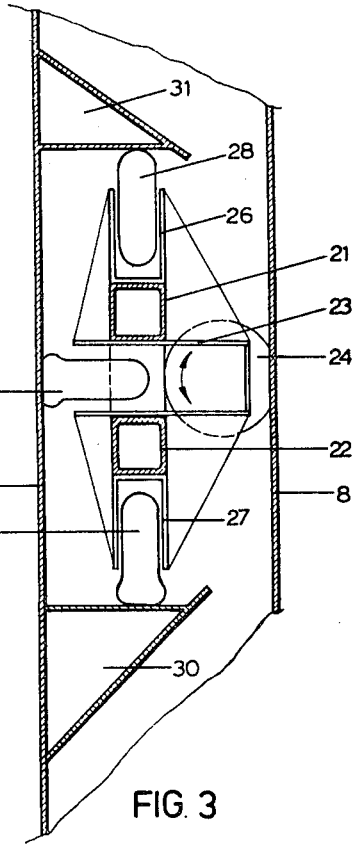
Figure 2:
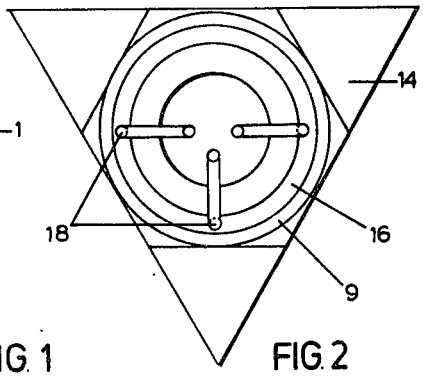

The invention will be more particularly described below in connection with an exemplary embodiment with reference to the accompanying drawing, wherein:

FIG. 1 shows a schematic, partly sectioned elevation of an apparatus for carrying out the method of the invention, FIG. 2 shows the apparatus in FIG. 1 viewed from above, and FIG. 3 shows a detail of the apparatus in FIG. 1.

As apparent from FIG. 1, the apparatus comprises two main members, more specifically a lower member 1 in the form of an essentially tubular envelope or shell body, and an upper member 2 forming a so-called gas bell such as more particularly described below.

The tubular shell body of the lower member 1 is open at both ends, and in the illustrated embodiment it has a cylindrical lower portion 3 having a relatively large diameter (e.g. in the range of 5–50 m) and passing via a conically tapering portion 4 into a cylindrical upper portion 5. In the conical transition portion 4 there is provided a ring-shaped or annular buoyancy or trim tank 6 which is arranged for variation of the buoyancy of the lower member. The illustrated design or shape of the shell body implies that its center of gravity is at a low position, so that the shell body will stand upright or vertically in the sea in submerged position. In a floating operational position the lower member 1 may be kept in place in a suitable position by means of dynamic positioning, or it may be moored in a traditional way by means of anchor lines or the like.

The gas bell portion of the upper member 2 comprises an annular casing or outer wall 7 which is dimensioned to embrace or enclose the upper portion 5 of the shell body at a radial distance therefrom, and an annular inner wall 8 enclosed by the upper portion of the shell body. Through a cover portion 9 these walls are mutually sealingly interconnecting at the top, so that there is formed a downwards open annular compartment or collecting chamber 10 having an inverted U-shaped cross-section and into which the upper portion or top part 5 of the shell body projects. The inner wall 8 of the gas bell extends downwards within the shell body 1, and in the illustrated embodiment, it comprises a downwardly tapering or partially conical bottom part 11 closing the central space or chamber 12 defined by the inner wall 8. Such as suggested in FIG. 1, a ballast or trim tank 13 for height positioning is provided in the bottom part 11. Further, the bottom part 11 and the central chamber 12 are arranged (in a way not more fully shown) for the reception of operational installations and auxiliary equipment for use in operation of the system, such as pumps, compressors, turbines, generators, fans, inert gas installations, etc. For this purpose one or more operation or equipment decks (not shown) may be provided in the central chamber 12.

As shown in FIG. 1, the upper member is also provided with an upper external deck or platform 14 which is supported by a supporting wall 15 which, in the illustrated embodiment, is an extension of the inner wall 8 of the gas bell. In FIG. 2 the platform 14 is shown to have a triangular shape but this, of course, is just meant to be an example.

The upper member further comprises a tube system for draining or carrying off gas collected or accumulated in the gas bell during operation. The tube system is schematically shown in FIGS. 1 and 2 and comprises in the illustrated embodiment an annular conduit or manifold 16 to which there is connected a number of pipes 17 extending downwards into the annular collecting chamber 10 and having different lengths so that they extend a different distance downwards in the collecting chamber as indicated in FIG. 1. The tubes 17 can have a fixed or adjustable capacity and constitute relief tubes which will automatically begin working for drainage or discharge of gas when the gas volume in the collecting chamber corresponds to the downwards extending length of the tube in question. Thus, this arrangement can replace valves for automatic opening by a certain positive pressure. The annular conduit 16 may be provided with suitable drainage means for the drainage of the possible water which is pressed upwards from the tubes 17 when these begin working.

From the annular conduit 16 a number of gas exhaust tubes 18 lead to a centrally located burner (not shown) which is arranged at the upper end of the tubes. The shown arrangement enables controlled drainage or discharge of variable quantities of gas under stable pressure conditions, and also pressure and volume control by local consumption on the apparatus itself, when the gas is utilized for example in the way stated by way of introduction, e.g. for the production of electric power.

In the schematic view of FIG. 2, wherein the apparatus is shown as viewed from above, the limiting walls of the gas bell are shown to have a circular shape, but other geometrical shapes may very well be feasible from practical considerations, e.g. of transportational and/or structural nature.

With the shown location of the gas bell of the upper member 2 within the shell body 1 there is, as previously mentioned, formed a collecting chamber 10 having a circular cross-section and forming a so-called liquid trap against the atmosphere. This is of substantial importance for the function and safety of the apparatus, as the gas pressure in the collecting chamber can be influenced by means of the trim tanks of the upper member. In this way there is achieved an explosion safe-guarding of the system, as the positive pressures which can develop by an uncontrolled, rapid combustion, may be released through the liquid trap.

In the illustrated embodiment the lower member 1 and the upper member 2 are kept in place in relation to each other by means of an upper and a lower localization means 20 allowing vertical movement of the two members in relation to each other, and in addition relative rotation of the members about a common longitudinal axis. Such an arrangement may have practical advantages, but the two main members may in practice also be built as one unit. Accordingly, it is conceivable that the principle as such can be used as a permanent safety measure on fixed production platforms, such as e.g. the Condeep type, but then in a version which is especially adapted to the structural and productional requirements at issue. Similarly, the principle allows the apparatus to be of a submerged design wherein only the tube system for discharge of gas extends above the sea.

A section through an embodiment of a localization means or guiding arrangement 20 is shown on an enlarged scale in FIG. 3. The device comprises an annular carrier extending around the circumference of the inner wall 8 of the gas bell in the space between this wall and the upper wall portion 5 of the shell body, and including a pair of parallelly extending channel sections 21 and 22. Between the channel sections and at suitable intervals along the circumference there are provided holders 23 for an inner wheel 24 which is rotatable about an essentially horizontal axis and rests against the inner wall 8 of the gas bell, and an outer wheel 25 which is rotatable about an essentially vertical axis and rests against the shell wall 5. At suitable intervals there are further arranged upper holders 26 and lower holders 27 receiving respective wheels 28 and 29, which are rotatable about horizontal axes. The lower wheel 29 is supported by an upper supporting surface of a carrier member 30 attached to the inner side of the shell wall 5 and extending around the circumference of the shell. For guiding of the rolling movement of the upper wheel 28 in the horizontal plane there is also shown to be arranged a guiding member 31 arranged in a manner similar to that of the supporting member 30. As regards this arrangement of the upper holder 26, wheels 28 and guiding members 31, this is provided as an additional safety, but it may possibly be omitted. In any case the spacing between the upper holder and wheel units may be substantially larger than the spacing between the number of lower holder and wheel units carrying the weight of the entire localization means. Preferably, the wheels have pneumatic tires in order to obtain a resilient support. It will be understood that the inner wheel 24 allows axial movement of the upper member 2 in relation to the lower member 1, whereas the outer wheel 25 allows relative rotational movement of the two members in the horizontal plane.

The described embodiment only represents an exemplary embodiment, as alternative embodiments will easily be contemplated by experts in this field.

The described localization means allow the lower member and the upper member to be trimmed vertically in the sea independent of each other within predetermined criteria of operational need, and furthermore, when the lower member is fixedly anchored or standing on the sea bed, the upper member may be rotated in the horizontal plane, e.g. so that it always can be manoeuvred with the same side towards the wind direction. In this connection the outer wall or casing of the gas bell may be shaped so that a possible uncontrolled discharge of gas will take place downwind when the upper member is positioned with the intended or opposite side towards the wind direction.

The upper and lower members may further be arranged to be transported in the sea independent of each other, and the lower member may then advantageously be provided with at least one floating tank which, when filled with air, causes the shell sides to adopt an essentially horizontal position in the sea.

The operation of the apparatus will be described in the following.

In e.g. an uncontrolled blow-out at the sea bed, oil or gas or a mixture of oil and gas will be in continuous motion towards the surface. Under extreme conditions an oil/gas fire will break out and persist at the surface.

The apparatus according to the invention is approached towards the emergency area with the lower and upper members trimmed to give a collected, enclosed gas volume a predetermined minimum pressure. The collecting chamber 10 is preferably filled with an inert gas in order to prevent the risk for creating explosion-dangerous mixtures when the gas from the sea bed is released into the chamber. As the oil/gas mixture is caught by the shell body standing in the sea, part of the requirements for a gas/oil fire at the surface will disappear, and a possible fire-fighting operation will be able to be rapidly effected by the use of inert gases or chemical means.

The hydrocarbons rising in the water towards the surface will be collected inside the shell body when it is properly positioned. Due to gravitational forces the water inside the shell body will be displaced by the rising or ascending oil. Gas bubbles will travel through the water/oil mixture and eventually separate from these components as they reach the collecting chamber 10. The pressure in the collecting chamber will gradually increase until a predetermined static pressure Ps is established as a result of the fact that the supplied gas is compressed and slowly displaces the liquid inside the bell as this liquid communicates with the surrounding sea. The total pressure in the collecting chamber 10 is determined by the trimmed displacement of the central body of the gas bell, whereby also the draft (H) in the sea of the outer wall 7 is defined. Consequently, the maximum existing pressure within the collecting chamber 10 at any moment in time will be equivalent to H m water column as shown in FIG. 1. If for any reason the pressure within the gas collecting chamber should exceed this maximum value, the gas will escape to the atmosphere through the sea surrounding the outer wall of the gas bell.

The pressure within the collecting chamber, Ps m water column, must always be less than H m water column and is equal to the difference between H and h, where h is the height of the water column remaining between the outer wall 7 of the gas bell and the shell wall 5. When Ps reaches a suitable value, discharge of gas in varying quantities can take place while the pressure is being kept essentially constant. The mixture of the inert gas and natural gas is released by activating one or more of the gas tubes leading to the burner at the top of the structure. A small pilot flame provides for igniting the mixture at the moment when the requirements for a continuous combustion have been reached, i.e. when the mixture of natural gas and inert gas has been evacuated from the collecting chamber 10 and the natural gas alone is mixed with combustion air.

Control is thereby established. The liquid trap H-h prevents supply of air to the collecting chamber which by now contains only natural gas. The force for driving the gas to the burner (or to the point of utilization) is provided by the positive pressure Ps caused by the gas continuously arriving at the collecting chamber, and the pressure is kept constant or within given limits by manual or preferably automatic adjustment of the gas flow through one or more of the gas tubes 17. These tubes, which are projecting downwards into the collecting chamber, will initially have their ends submerged in the water within the liquid trap, and will consequently be activated or begin working when the pressure Ps rises. With an increasing pressure the tubes will come into operation in sequence at the same time as a reduced pressure will bring the water back and cause a gradual reclosing of the tubes.

Drainage or transfer of gas from the annular conduit 16 to the burner, or to the point of consumption or utilization, takes place through the tubes 18 which are connected in parallel and of which each has a separate, manual or preferably automatic flow control valve which is adjusted to suit the pressure conditions in the annular conduit. With a modest gas output from the well only one tube will be in operation which tube, however, will be shut off when the gas velocity reaches a predetermined value. Each tube 18 also has an upper capacity limit determined by a given gas velocity (pressure loss) in the conduit plus a differential pressure across an orifice meter. In the event of an increased gas output or gas discharge from a well the collecting chamber pressure Ps will also increase and result in a need for increased capacity with respect to burning or consumption (production). When the conditions are met, the next tube in the tube system comes into function until all the tubes operate with defined gas velocities by the actual driving pressure Ps. The driving pressure Ps may be adjusted by changing the displacement of the upper member 2. By lowering the upper member the height H can be increased. The driving pressure or force Ps can be increased correspondingly. Consequently, with a given tube system for the transport of the natural gas to the point of burning, the capacity will increase in accordance with otherwise known physical rules.

The oil accumulated in the submerged shell body, will gradually displace the water within the body. This water will be displaced to the surrounding sea. The upper member 2, which initially was floating in sea water, will now have its displacement partly in oil and partly in water or even solely in oil. The ratio is dependent upon the level of oil which is wanted to be maintained in the shell body, but implicitly in the system there is an operational wish that the entire upper member should float in oil alone. The reduced buoyancy which is then offered, is compensated by adjusting e.g. the ballast tanks of the upper member. As mentioned, the apparatus enables a "production" of oil and natural gas by means of pumps, compressors, cooling machinery etc., installed on the utility decks provided inside the central chamber 12, whereby the oil and/or liquefied natural gas (LNG) can be transferred to nearby vessels by means of known technology, such as e.g. flexible tubes. It is presupposed that the pump installation in the upper member is dimensioned in such a way that it is possible to handle the oil quantity with variations which can be expected from an oil well. If the collecting shell should be completely filled with oil, e.g. because of pump failure, this implies that the oil will escape to the surrounding sea to subsequently ascend to the sea surface outside of the apparatus. Provided that the apparatus is properly positioned above the well, possible gas from the well will still be collected within the shell body and ascend to the surface of the oil enclosed by the shell body. The oil escaping from the lower circumference of the shell body, is likely to consist of the vertical oil column immediately inside the shell body, since a temperature reduction in the oil by heat transmission through the shell body will influence oil density, viscosity, etc. Horizontal movements in the water caused by water entrained into a vertical gas/oil stream will influence the situation, as will also the lower diameter of the shell body and the internal pattern of turbulence caused by the rising and expanding gas inside the shell body.

I claim:

1. A method for collecting oil and gas flowing uncontrolled into a body of water beneath the water surface, especially in a blow-out from a point at the sea bed, wherein discharging oil and gas from the blow-out location is caught and ascends towards the surface within a tubular shell body, comprising the steps of: collecting the ascending gas in a floating gas bell provided at the upper end portion of the shell body, forming a gas or liquid trap against the surrounding water in that said bell has an outer wall projecting downwards and surrounding an upper portion of the shell body; and placing the gas automatically under a controllable positive pressure.

2. A method according to claim 1, further comprising the step of draining of the gas from the gas bell at a certain positive pressure in a controlled manner through tube connections to a place of combustion or consumption.

3. A method according to claim 2, wherein the accumulated gas is drained off through a number of tubes projecting downwards in the gas bell with different vertical lengths in order to begin working in dependence of the gas pressure in the bell.

4. A method according to claim 1, wherein the ascending oil is collected in the shell body for the formation of an oil column which, together with the gas accumulated in the gas bell, is in pressure equilibrium with the surrounding water.

5. A method according to claim 2, wherein the ascending oil is collected in the shell body for the formation of an oil column which, together with the gas accumulated in the gas bell, is in pressure equilibrium with the surrounding water.

6. A method according to claim 3, wherein the ascending oil is collected in the shell body for the formation of an oil column which, together with the gas accumulated in the gas bell, is in pressure equilibrium with the surrounding water.

7. An apparatus for collecting oil and gas flowing uncontrolled into a body of water beneath the water surface, especially in a blow-out from a point at the sea bed, and comprising: a tubular shell body for catching oil and gas ascending towards the surface from the blow-out location; an upper member constituting a gas-collecting bell; a lower member constituted by the shell body; the upper member comprising a shell-body-enclosing outer wall and an inner wall enclosed by the shell body, which walls are mutually sealingly connected at the top thereof so as to form an annular compartment which is open at the bottom and into which a top part of the shell body projects; said inner wall including a downwardly projecting bottom part which encloses a central space defined by the inner wall.

8. An apparatus according to claim 7, wherein the shell body has its center of gravity so disposed that the shell wall is kept essentially vertical in operational position.

9. An apparatus according to claim 7, wherein the lower member and the upper member are separate members and are intended to float in operational position, the lower member being provided with a ballast tank means for variation of the buoyancy thereof.

10. An apparatus according to claim 8, wherein the lower member and the upper member are separate members and are intended to float in operational position, the lower member being provided with a ballast tank means for variation of the buoyancy thereof.

11. An apparatus according to claim 7, wherein the upper member is provided with a tubing system for drainage of the accumulated gas, which system comprises a number of parallelly connected tubes projecting downwards in the annular compartment of the upper member.

12. An apparatus according to claim 11, wherein said tubes project downwards in the annular compartment with different vertical lengths.

13. An apparatus according to claim 7, wherein the upper member and the lower member are arranged to be trimmed vertically in the water independent of each other.

14. An apparatus according to claim 7, wherein the upper member is rotatable in a horizontal plane relatively to the lower member.

15. An apparatus according to claim 7, wherein the upper member and the lower member are arranged to be transported in the water dependent of each other.

16. An apparatus according to claim 15, wherein the lower member is provided with at least one floating tack which, when filed with air, causes the side wall of the lower member to be disposed in an essentially horizontal position in the water.

17. An apparatus according to claim 15, further comprising ballast tanks for adjusting the displacement of the upper member in the medium with the shell body.

* * * * *